United States Patent [19]

Hayashi et al.

[11] Patent Number: 4,850,469

[45] Date of Patent: Jul. 25, 1989

[54] COIN SEPARATOR

[75] Inventors: Yukichi Hayashi, Sakado; Yonezo Furuya, Saitama; Ichiroh Fukuda, Kawagoe; Masaki Akagawa, Saitama; Osamu Kobayashi, Tsurugashima, all of Japan

[73] Assignee: Kabushiki Kaisha Nippon Conlux, Tokyo, Japan

[21] Appl. No.: 139,668

[22] Filed: Dec. 30, 1987

[30] Foreign Application Priority Data

Jan. 12, 1987 [JP] Japan ..... 62-4426

[51] Int. Cl.[4] ..... G07D 3/04; G07D 5/08

[52] U.S. Cl. ..... 194/318; 194/338

[58] Field of Search ..... 194/317, 318, 319, 334, 194/338

[56] References Cited

U.S. PATENT DOCUMENTS

| | | | |
|---|---|---|---|
| 2,453,437 | 11/1948 | Hokanson | 194/334 X |
| 4,220,234 | 9/1980 | Sheltra | 194/338 X |
| 4,286,703 | 9/1981 | Schuller et al. | 194/317 |
| 4,385,684 | 5/1983 | Sugimoto et al. | 194/318 |
| 4,576,275 | 3/1986 | Kobayashi et al. | 194/317 X |
| 4,666,027 | 5/1987 | Ostroski et al. | 194/318 X |

*Primary Examiner*—F. J. Bartuska

*Attorney, Agent, or Firm*—Diller, Ramik & Wight

[57] ABSTRACT

A coin separator having a first coin passage along which coins are guided, a coin detector disposed in the first coin passage for discriminating whether coins passing therethrough are true or false and to which group belong coins which are discriminated as true and outputting a signal relative to whether the coins are true or false and a group signal indicative of the group to which the discriminated coins belong, a true coin passage and a false coin passage each connected to the first coin passage, a first dividing mechanism for introducing the coins passing through the first coin passage into either the true coin passage or the false coin passage in response to the signal outputted from the coin detector, a plurality of second coin passages connected to the true coin passage, a second dividing mechanism for introducing the coins passed through the true coin passage into one of the plurality of second coin passages in response to the group signal outputted from the coin detector, and a third dividing mechanism for dividing the coins passed through each of the second coin passages into a plurality of groups with the third dividing mechanism being provided in each of the plurality of second coin passages.

7 Claims, 6 Drawing Sheets

COIN SEPARATOR

BACKGROUND OF THE INVENTION

1. Field of the Invention

The present invention relates to a coin separator usable for automatic vending machine, coin exchanger, service machine or the like.

2. Description of the Related Art

In order to improve a coin slection accuracy, there has been heretofore provided a so-called electronic type coin separator which is so constructed that coin separation is achieved with the use of electronic separating means but without any use of mechanical separating means such as cradle, deflector or the like.

The conventional coin separator is equipped with a coin discriminator comprising an oscillation coil and a receiving coil. This coin discriminator is composed of a sensor portion comprising the aforesaid oscillation coil and receiving coil and a controller. Specifically, the controller is constructed on the basis of a technical knowledge that an attenuated voltage is different from coin to coin when the coin passes across the sensor portion, and it is operated in such a manner that an attenuated voltage with an allowable range added thereto which is previously measured and stored for each of coins is compared with a received voltage fed from the sensor portion and a discrimination signal relative to whether coins are true or false as well as a discrimination signal relative to the kind of coins are outputted with reference to results of the comparison. The conventional coin separator actuates a plurality of solenoids for selecting coin passages in accordance with the signals outputted with reference to the results of discrimination of the controller, and then carries out separation relative to whether coins are true or false and separation relative to the kind of coins so that false coins are delivered to a predetermined coin passage and true coins are separately introduced into predetermined coin passages which are provided in accordance with the kind of true coins.

When, for instance, four kinds of coins C1, C2, C3 and C4 are to be separated one from other with the use of the conventional coin separator as mentioned above, at least four solenoids to be actuated in response to discrimination signals transmitted from a coin discriminator are required inclusive solenoids for separating true coins from false coins and solenoids for separating coins in accordance with the kind of coins. Consequently, the number of components constituting the coin separator increases and the coin separator itself becomes large and expensive. Further, the conventional coin separator has other problems, namely, the assembling process becomes complicated and moreover a circuit for the coin discriminator becomes complicated in structure due to a number of solenoids to be actuated with the result that special knowledges are required for maintenance and specification both of which can not be performed easily and simply.

SUMMARY OF THE INVENTION

The present invention has been made to solve the foregoing problems and its object resides in providing a coin separator of which the number of solenoid plungers can be reduced and which can be produced at an inexpensive cost in a compact structure.

According to the present invention, the kind of coins which are fed into the coin separator are detected by means of an electronic type coin discriminator, the coins are then divided into a plurality of groups by actuating first separation means so as to allow them to be separately introduced into a coin passage allocated to one of the divided coin passages and the coins in the coin passage belonging to a certain group divided by the first coin separation means are divided further by mechanical separation means. Dividing of coins into plural groups is achieved in such a manner that, for instance, a diameter of coins belonging to a certain group is substantially large compared with a diameter of coins belonging to other group in order to assure that mechanical dividing to be effected later becomes easy.

Owing to the arrangement of the coin separator made in that way, a number of solenoid plungers to be used can be reduced without any reduction of separation accuracy of coins fed into the coin separator.

DESCRIPTION OF THE PREFERRED EMBODIMENT

Now, the present invention will be described in a greater detail hereunder with reference to the accompanying drawings which illustrate a preferred embodiment thereof. Incidentally, in the illustrated embodiment, description will be made as to a case where four kinds of coins identified by C1, C2, C3 and C4 are used.

Figure 1:
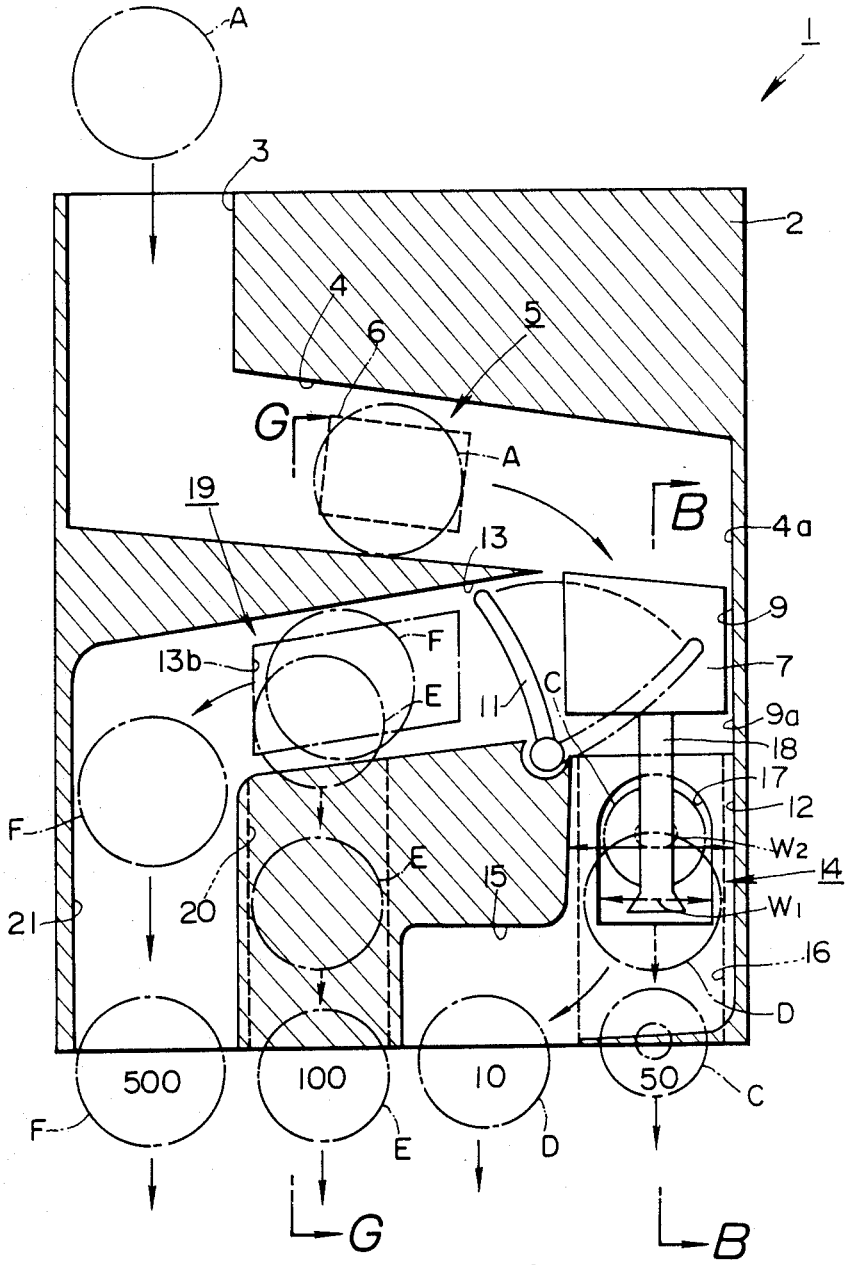
FIG. 1 is a schematic vertical sectional view of a coin separator in accordance with an embodiment of the invention.
Figure 2:
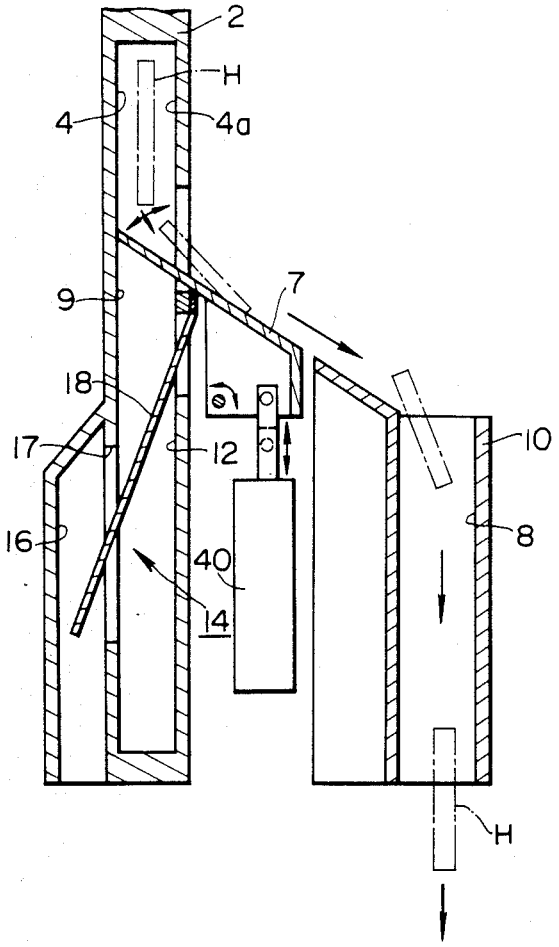
FIG. 2 is a fragmental enlarged vertical sectional view of the coin separator taken along line B—B in FIG. 1.

FIG. 1 is a schematic vertical sectional view of a coin separator 1 in accordance an embodiment of the invention. This coin separator 1 is formed with a coin insert port 3 at the position located at the left side of the upper surface of a main plate 2 which is molded of hard high molecular material. As is apparent from the drawing, the coin insert port 3 is communicated with a first coin passage 4 which extends in the rightward direction at a certain downward inclination angle. A sensor 5 of a coin discriminator to be described later is disposed at a predetermined position on both side walls of the first coin passage 4 in order to discriminate true coins from false coins and moreover determine the kind of the discriminated coins. It should be noted that the sensor 5 is composed of an oscillation coil 6 and a receiving coil (not shown) which are oppositely located at a predetermined distance kept therebetween. The first coil passage 4 is bifurcated in two coin passages at the end part 4*a* thereof, one of them being a second coin passage 8, as shown in FIG. 2, which is an enlarged vertical sectional view taken along line B—B in FIG. 1, and the other one being a third coin passage 9 which is provided downwardly of the end part 4a of the first coin passage 4. Specifically, the second coin passage 8 is intended to guide movement of false coins from a first lever 7 which serves to selectively distribute them to the second coin passage 8 and the third coin passage 9 is intended to guide movement of true coins. As shown in FIG. 2, the first lever 7 is normally held at the position where the coins transferred through the first coin passage 4 are delivered to the second coin passage 8, by means of a first solenoid plunger 40 adapted to turn the first lever 7 in response to a discrimination signal transmitted from the coin discriminator. The second coin passage 8 is formed in a separate cover 10 which covers the rear surface of the main plate 2. On the other hand, as shown in FIG. 1, the end part 9*a* of the third coin passage 9 is bifurcated into two coin passages, one of them being a fourth coin passage 12 which is formed downwardly of the end part 9*a* of the third coin passage 9 to guide movement of coins belonging to a second coin group comprising C3 and C4 and the other one being a fifth coin passage 13 which extends in the leftward direction at a certain downward inclination angle to guide movement of coins belonging to a first coin group comprising C1 and C2. A second lever 11 is disposed at an intersection between the fourth coin passage 12 and the fifth coin passage 13 to separate into the first and second coin groups the true coins which have been transferred from the third coin passage 9. Incidentally, the second lever 11 is normally held at the position where the true coins which have been transferred from the third coin passage 9 are introduced into the fourth coin passage 12, by means of a solenoid plunger 41 (see FIG. 5) adapted to turn the second lever 11 in response to a discrimination signal transmitted from the discriminator. Further, the fourth coin passage 12 is bifurcated into a sixth coin passage 15 and a seventh coin passage 16 via first rail type coin selecting means 14 for selecting coins in dependence on a difference in diameter between C3 coin C and C4 coin D. This first rail type coin selecting means 14 is composed of a vertically elongated hole 17 formed on the side surface of the fourth coin passage 12 and a leaf spring 18 for thrusting C3 coin C which falls downwardly through the vertically elongated hole 17. A width W1 of the hole 17 is determined appreciably larger than a diameter of C3 coin C but smaller than a diameter of C4 coin D, while a width W2 of the fourth coin passage 12 is determined appreciably larger than a diameter of C4 coin D. Accordingly, when C4 coin D and C3 coin C are introduced into the fourth coin passage 12, C3 coin C is introduced into the seventh coin passage 16 by means of a combination of the hole 17 and the spring 18 and C4 coin D falls downwardly against thrusting force of the spring 18 to be introduced into the sixth coin passage 15.

Figure 3:
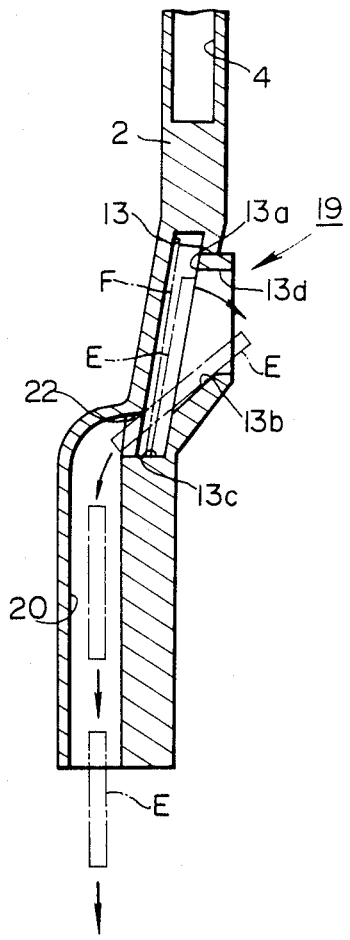
FIG. 3 is a fragmental enlarged vertical sectional view of the coin separator taken along line G—G in FIG. 1.

On the other hand, the fifth coin passage 13 is bifurcated into an eighth coin passage 20 through which C2 coin E belonging to the first coin group is introduced via second rail type coin selecting means 19 and a ninth coin passage 21 through which C1 coin F is introduced. As shown in FIG. 3, which is an enlarged vertical sectional view taken along line G—G in FIG. 1, the second rail type coin selecting means 19 is constituted by a window 13*b* which is formed on the side wall 13*a* of the fifth coin passage 13 which is formed in a rightwardly inclined state by a predetermined angle, and a height as measured from the bottom 13*c* of the fifth coin passage 13 to the upper edge 13*d* of the window 13*b* is determined appreciably larger than a diameter of C2 coin E but smaller than a diameter of C1 coin F. Accordingly, when C1 and C2 coins are introduced through the fifth coin passage 13, C1 coin F moves linearly through the fifth coin passage 13 to be introduced into the ninth coin passage 21, as shown in FIG. 1, since the diameter of C1 coin F is larger than the height as measured from the bottom 13*c* of the fifth coin passage 13 to the upper edge 13*d* of the window 13*b*. On the other hand, since the diameter of C2 coin E is smaller than the aforesaid height, C2 coin E is caused to incline further toward the window 13*b* and it is then introduced into the eighth coin passage 20 via horizontally elongated hole 22 formed between the fifth coin passage 13 and the eighth coin passage 20.

Next, description will be made below in more details as to the coin discriminator for discrimating true coins from false coins, discriminating the kind of discriminated true coins and discriminating whether the discriminated coins belong to the first coin group or the second coin group.

Figure 4:
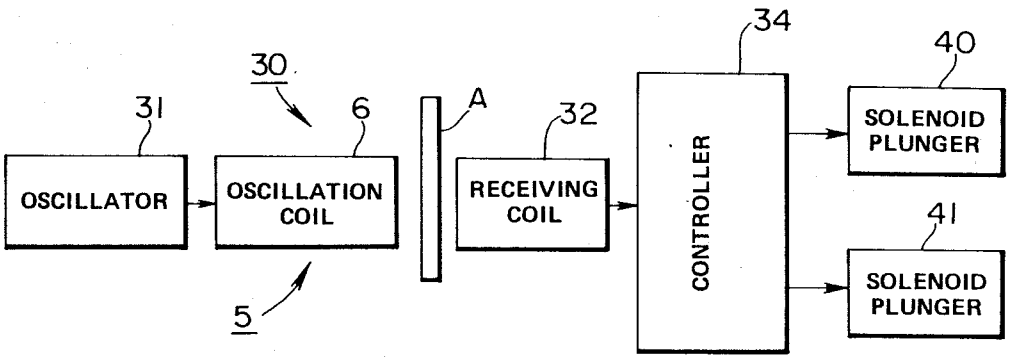
FIG. 4 is a block diagram of a coin discriminator for the coin separator of the invention.

FIG. 4 is a block diagram illustrating the coin discriminator 30 and same components as those shown in FIGS. 1 to 3 are represented by same reference numerals. The coin discriminator 30 is composed of a sensor portion 5 comprising an oscillator 31, an oscillation coil 6 and a receiving coil 32 and a controller 34. Specifically, the controller 34 is so constructed that a comparison is made between an attenuated voltage with an allowable range added thereto which is previously measured and stored for each of coins and a received voltage transmitted from the sensor portion 5 in response to a detection signal generated in the sensor portion 5, discrimination is made on the basis of the comparison results as to whether a coin moving across the sensor portion 5 is true or false, and in the case where the coin is a false coin, actuation of the first solenoid plunger 40 and the second solenoid plunger 41 is interrupted, in the case where the coin which is discriminated as a true coin belongs to the first coin group including C1 and C2, the first solenoid plunger 40 and the second solenoid plunger 41 are actuated and in the case where the coin which is discriminated as a true coin belongs to the second coin group including C3 and C4, only the first solenoid plunger 40 is actuated.

Next, description will be made below as to operation of the coin selector 1 as described above and moreover description will be made below in more details as to structure of the same.

When a coin A which is inserted through the coin insert port 3 shown in FIG. 1 is discriminated as a false coin by means of the coin discriminator 30 shown in FIG. 4, no signal is outputted from the controller 34 to actuate the first and second solenoid plungers 40 and 41, causing the first and second levers 7 and 11 to be held at the position as represented by real lines in FIGS. 1 and 2. Thus, as shown in FIG. 2, the false coin H moving through the first coin passage 4 is delivered to the second coin passage 8 via the first lever 7 and thereafter it is returned to a coin return port which is not shown in the drawings.

Figure 5:
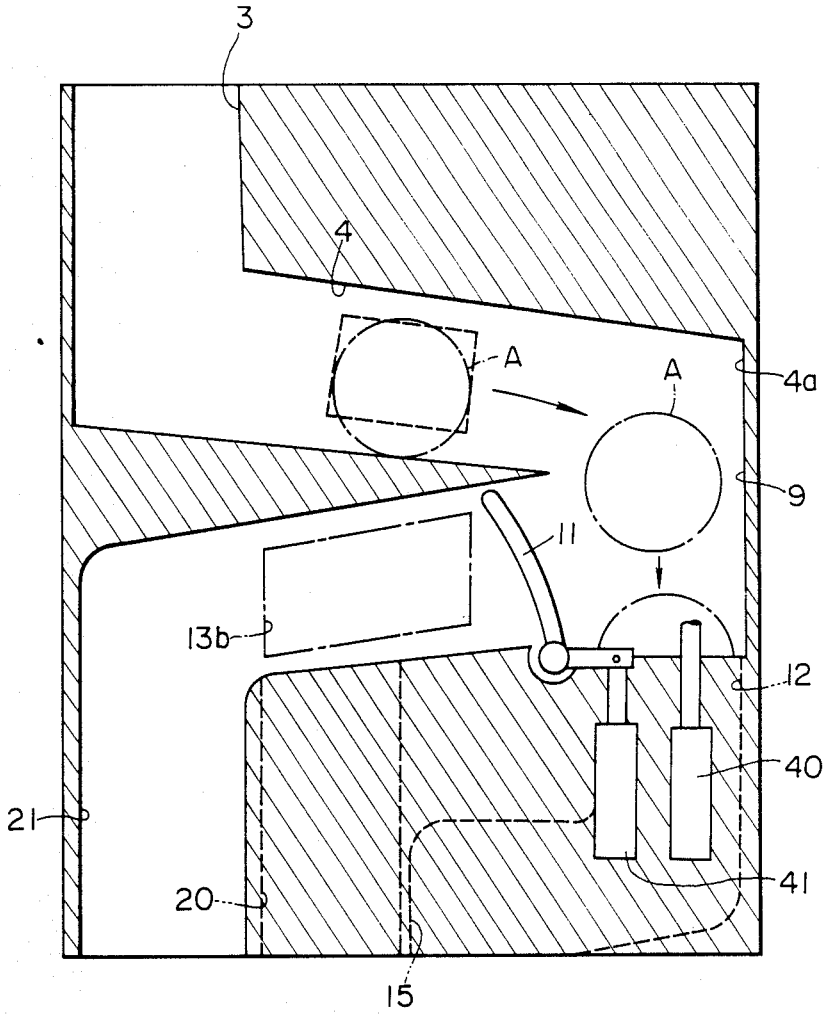
FIGS. 5 to 8 are vertical sectional views of essential parts of the coin separator respectively, particularly illustrating function thereof.
Figure 6:
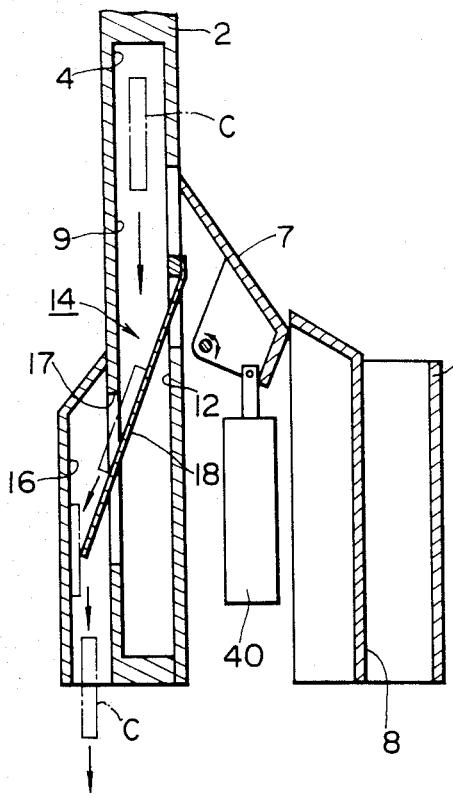
Figure 7:
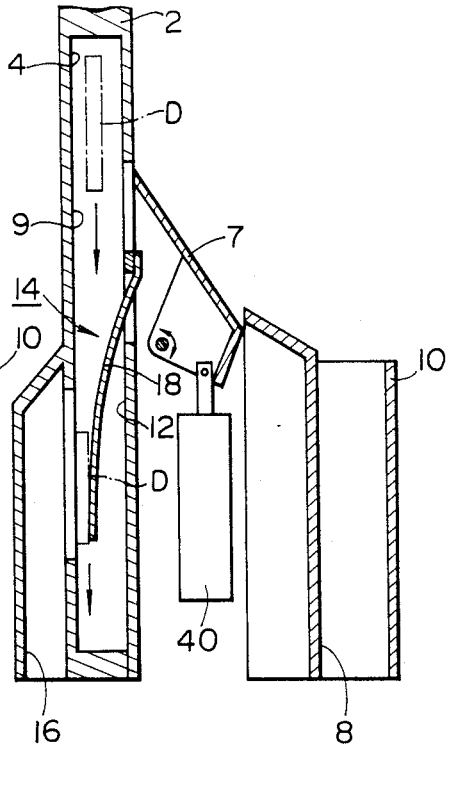

Next, when a coin A which is inserted through the coin insert port 3 shown in FIG. 1 is discriminated as a true coin by means of the coin discriminator 30 and moreover it is discriminated that it belongs to the second coin group including C3 and C4, a signal is outputted from the controller 34 to actuate only the first solenoid plunger 40, causing the first lever 7 to be turned in the clockwise direction by a predetermined angle, as shown in FIGS. 6 and 7, whereby the coin A moving through the first coin passage 4 is introduced into the third coin passage 9 as shown in FIG. 5 which is a vertical sectional view illustrating main components in FIG. 1. Since no signal is outputted from the discriminator 30 to actuate the second solenoid plunger 41, the second lever 11 is immovably held at the position as represented by real lines in FIG. 5 whereby C3 and C4 coins are introduced into the fourth coin passage 12. In the case where the coin which has been introduced into the fourth coin passage 12 is C3 coin C, the latter is delivered to the seventh coin passage 16 via the spring 18 and the hole 17 as shown in FIG. 6 and it is then received in a coin collecting box (not shown) which is allocated to C3 coin C and disposed at the position located downwardly of the seventh coin passage 16. Further, in the case where the coin which has been introduced into the fourth coin passage 12 is C4 coin D, it falls downwardly against resilient force of the spring 18 constituting the first rail type coin selecting means 14 as shown in FIG. 7 and it is then delivered to the sixth coin passage 15 shown in FIG. 1 to be received in a coin collecting box (not shown) which is allocated to C4 coin D and disposed at the position downwardly of the sixth coin passage 15. Incidentally, since a difference in diameter between C4 coin and C3 coin is determined very large compared with, for instance, a difference in diameter between C4 coin and C2 coin, it is assured that selection is achieved at a high accuracy even with the use of the first rail type coil selecting means 14.

Figure 8:
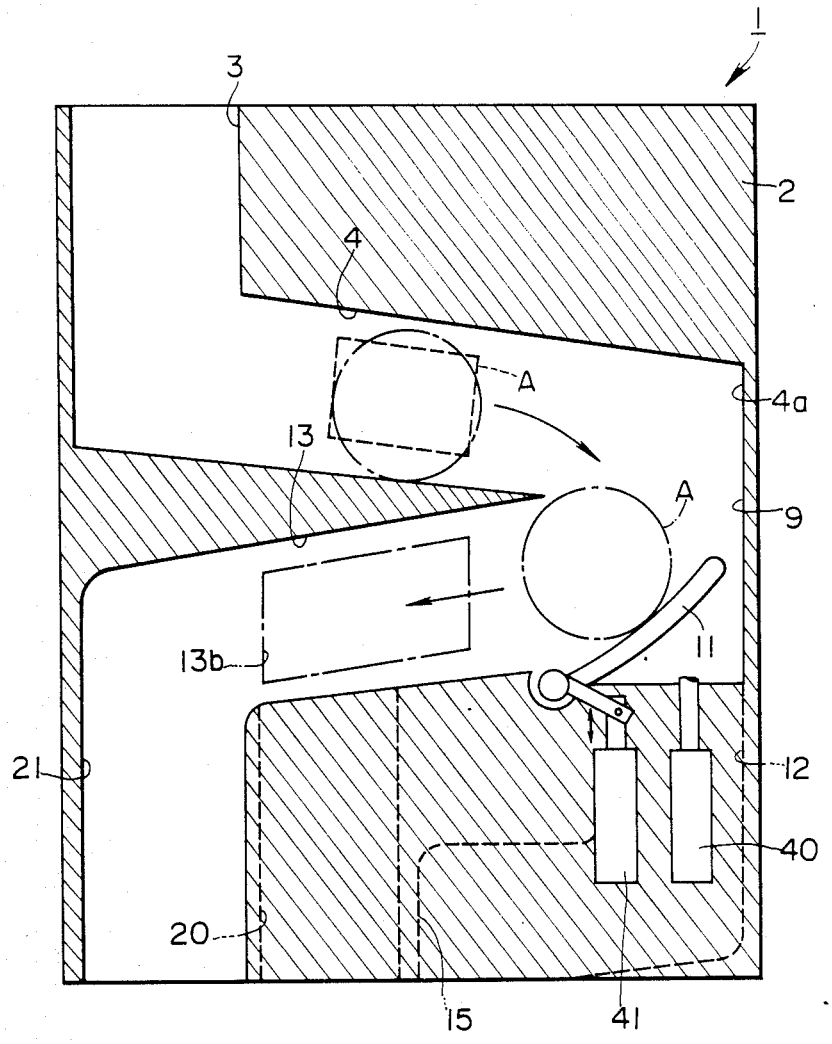

Next, when a coin A which is inserted through a coin insert port 3 shown in FIG. 1 is discriminated as a true coin by means of the coin discriminator 30 in FIG. 4 and it is discriminated that it belongs to the first coin group including C1 and C2, a signal is outputted from the controller 34 to actuate the first and second solenoid plungers 40 and 41, causing the first lever 7 to turn in the clockwise direction by a predetermined angle as shown in FIG. 6, whereby the coin A moving through the first coin passage 4 is introduced into the third coin passage 9 as shown in FIG. 8 and it is then delivered to the fifth coin passage 13 by means of the second lever 11 which has been turned to the position as represented by real lines in Fig. 8 by actuating the second actuating plunger 41. In the case where the coin which has been delivered to the fifth coin passage 13 is C2 coin E, it is caused to incline toward the window 13b constituting the second rail type coin selecting means 19 as shown in FIG. 3. Consequently, C2 coin E moves through the hole 22 to be introduced into the eighth coin passage 20 and thereafter it is received in a coin collecting box (not shown) which is disposed at the position downwardly of the eighth coin passage 20. Further, in the case where a coin which is introduced into a fifth coin passage 13 is C1 coin F, it moves forwardly irrespective of the presence of the window **13*b* constituting the second rail type coin selecting means 19, as shown in FIG. 1. As a result, it is introduced into the ninth coin passage 21 shown in FIG. 1 and it is then received in a coin collecting box (not shown) which is allocated to C1 coin F and disposed at the position located downwardly of the ninth coin passage 21. Incidentally, since a difference in diameter between C1 coin and C2 coin is determined very large, it is assured that selection is achieved at a high accuracy even with the use of the second rail type coin selecting means 19**.

As will be apparent from the above description, the illustrated embodiment is based on the fact that a difference in diameter between C1 coin and C2 coin as well as a difference in diameter between C4 coin and C3 coin are large and it is practiced without any reduction of separating accuracy by separating true coins into a first coin group including C1 coin and C2 coin and a second coin group including C4 coin and C3 coin and carrying out separation of C1 coin from C2 coin and separation of C4 coin from C3 coin with the use of simple rail type coin separating means. Consequently, it suffices that there are required only two solenoid plungers which are actuated by an electronic type coin discriminator for discriminating whether coin which is fed into the coin selector is true or flase and what kind the coin belongs to. Thus, since the number of required solenoid plungers can be reduced without any reduction of separation accuracy of coins, the coin separator can be provided at an inexpensive cost in a compact structure. Further, since only two solenoid plungers to be actuated are required, the result is that a circuit of the coin discriminator for actuating the solenoid plungers becomes simple in structure and moreover maintenance and inspection operations can be simply performed without a need of special knowledges.

What is claimed is:

1. A coin separator comprising:

a first coin passage for guiding fed coins;

coin detecting means disposed in said first coin passage for discriminating whether coins passing through said first coin passage are true or false and what kind the coins which are discriminated as true coin belong to and outputting a signal relative to whether the coins are true or false as well as a group signal relative to the kind of coins indicating a group to which the discriminated coins belong;

a true coin passage and a false coin passage each being connected to said first coin passage;

first dividing means for introducing the coins passed through said first coin passage into either said true coin passage or said false coin passage in response to the signal outputted from said coin detecting means;

a plurality of second coin passages connected to said true coin passage;

second dividing means for introducing the coins passed through said true coin passage into one of said plurality of second coin passages in response to a group signal outputted from said coin detecting means; and third dividing means for dividing the coins passed through each of said second coin passages into a plurality of groups and said third dividing means being provided in each of said plurality of second coin passages.

2. The coin separator of claim 1 wherein said coin detecting means includes:

an oscillation coil arranged along said first coin passage so as to allow an electric current having a predetermined frequency to flow therethrough; and a receiving coil disposed opposite to said oscillation coil with said first coin passage interposed therebetween.

3. The coin separator of claim 1 wherein said first dividing means includes:

a first solenoid adapted to be activated in response to the signal relative to whether the coins are true or false outputted from said coin detecting means;

a first plunger actuated by said first solenoid; and a first lever actuated by said first plunger for dividing the coins passed through said first coin passage into either said true coin passage or said false coin passage.

4. The coin separator of claim 1 wherein said second dividing means includes:

a second solenoid adapted to be activated in response to the group signal outputted from said coin detecting means;

a second plunger actuated by said second solenoid; and a second lever actuated by said second plunger for dividing the coins passed through said true coin passage into either one of the plurality of said second coin passages.

5. The coin separator of claim 1 wherein said third coin dividing means comprises rail type dividing means for dividing the coins which have moved through said second coin passage into the kind in dependence on a difference in diameter of the coins.

6. A coin separator comprising:

an electronic type coin discriminator for discriminating whether coins fed into said coin separator are true or false and what kind the coins which are discriminated as true coin belong to and transmitting a discrimination signal relative to whether the coins are true or false as well as a discrimination signal relative to the kind of coins on the basis of results of the discrimination;

first solenoid plunger means for actuation in response to said discrimination signal relative to whether the coins are true or false, said discrimination signal being outputted from said electronic type coin discriminator;

a first lever for dividing the coins into true coins and false coins by actuating said first solenoid plunger means so that the true coins and false coins are separately introduced into a coin passage allocated to each of them;

second solenoid plunger means for actuation in response to said discrimination signal being outputted from said electronic type coin discriminator;

a second lever for dividing the true coins which have been divided by said first lever into a first coin group and a second coin group by actuating said second solenoid plunger means so that the coins belonging to said first coin group and the coins belonging to said second coin group are separately introduced into a coin passage allocated to each of them; and rail type coin separating means for separately introducing the coins which have been separately introduced into each of said coin passage allocated to each of said coin groups by said second lever, further into a plurality of coin passages allocated to each kind of the coins respectively in dependence on a difference in diameter of the coins, said rail type coin separating means being provided in each of said coin passages allocated to each coin group respectively.

7. The coin separator of claim 6 wherein said first coin group and said second coin group are so set that a diameter of each of the coins belonging to one coin group is distinctly different from each other to such an extent that separation between the coins within the group is readily achieved.

* * * * *